US010021755B1

(12) United States Patent
Ido

(10) Patent No.: US 10,021,755 B1
(45) Date of Patent: Jul. 10, 2018

(54) LIGHTING DEVICE AND LUMINAIRE

(71) Applicant: Panasonic Intellectual Property Management Co., Ltd., Osaka (JP)

(72) Inventor: Shigeru Ido, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/848,015

(22) Filed: Dec. 20, 2017

(30) Foreign Application Priority Data

Dec. 22, 2016 (JP) ..... 2016-249667

(51) Int. Cl.
*H05B 37/02* (2006.01)
*H05B 33/08* (2006.01)

(52) U.S. Cl.
CPC ..... *H05B 33/089* (2013.01); *H05B 33/0824* (2013.01)

(58) Field of Classification Search
None
See application file for complete search history.

(56) References Cited

U.S. PATENT DOCUMENTS 8,164,276 B2 * 4/2012 Kuwabara ..... H05B 33/083 315/185 R
9,439,255 B2 * 9/2016 Lin ..... H05B 37/02
9,497,812 B2 * 11/2016 Lee ..... H05B 33/083
2005/0057179 A1 * 3/2005 Madhani ..... B60Q 1/30 315/185 R
2012/0262075 A1 * 10/2012 Lynch ..... H05B 33/0818 315/192
2014/0049171 A1 * 2/2014 Liang ..... H05B 33/0806 315/187
2017/0019969 A1 * 1/2017 O'Neil ..... H05B 33/083

FOREIGN PATENT DOCUMENTS

JP 2013-225393 A 10/2013

* cited by examiner

*Primary Examiner* — Kretelia Graham
*Assistant Examiner* — Henry Luong
(74) *Attorney, Agent, or Firm* — Renner Otto Boisselle & Sklar, LLP

(57) ABSTRACT

A first control circuit is configured to detect a value of a load current flowing through a solid-state light source in a lighting time period, and control a control element at a first response speed so as to make the value of the load current agree with a first target value. A second control circuit is configured to detect the value of the load current in the lighting time period, and control the control element at a second response speed so that the value of the load current does not exceed an upper limit that is larger than a first target value. The second response speed is higher than the first response speed.

10 Claims, 7 Drawing Sheets

4
1A
Iin
17
Vin
18
RECTIFIER CIRCUIT
10
FILTER CIRCUIT
16
BLEEDER CIRCUIT
13
I1
I2
I3
Vcc
POWER SUPPLY CIRCUIT
14
Icc
11
FIRST DRIVE CIRCUIT
15
C12
D11
2
C13
D12
3
SECOND DRIVE CIRCUIT
12

LIGHTING DEVICE AND LUMINAIRE

CROSS-REFERENCE TO RELATED APPLICATION

This application is based upon and claims the benefit of priority of Japanese Patent Application No. 2016-249667, filed on Dec. 22, 2016, the entire content of which is incorporated herein by reference.

TECHNICAL FIELD

This disclosure relates to lighting devices and luminaires, more particularly, to a lighting device configured to supply an AC voltage, received from an AC power supply, to a solid-state light source without converting the AC voltage into a DC voltage so as to cause the solid-state light source to emit light, and a luminaire with the same.

BACKGROUND ART

Conventionally, there has been an LED lighting apparatus described in a Document 1 (JP 2013-225393 A), for example. The LED lighting apparatus in the Document 1 (hereinafter, referred to as a conventional example) includes: an LED string constituted by a series circuit in which LEDs (Light Emitting Diodes) are connected in series; a rectifier configured to full-wave rectify an AC voltage; and a light emission controller. In those, the rectifier and the light emission controller are included in a lighting device. The light emission controller performs constant current control for a drive current flowing through the LED string while adjusting the number of LEDs, which emits light, in accordance with a change in an input voltage (a pulsating voltage) supplied to the LED string via the rectifier. Furthermore, a dimmer described in the Document 1 has a TRIAC. By controlling the TRIAC, the dimmer is configured to control a phase of the AC voltage to be supplied from an AC power supply to the LED lighting apparatus so as to perform the dimming control for the LED lighting apparatus.

Incidentally, when the TRIAC of the dimmer is turned on in a phase close to a peak of the AC voltage, the input current into the lighting device may rapidly increase. Thus, there is a possibility that an overcurrent may flow through the lighting device.

SUMMARY

The present disclosure is directed to a lighting device and a luminaire, which can suppress an overcurrent when an input voltage is subjected to phase control.

A lighting device according to an aspect of the present disclosure includes a rectifier circuit configured to rectify an AC voltage to output a pulsating voltage. The lighting device further includes at least one drive circuit configured to, within a period of the pulsating voltage, switch between a lighting time period and a non-lighting time period in accordance with a voltage value of the pulsating voltage, the lighting time period being for supplying a load current to a corresponding solid-state light source, and the non-lighting time period being for supplying no load current to the corresponding solid-state light source. Each of the at least one drive circuit includes: a control element adjusting the load current to the corresponding solid-state light source; and a first control circuit configured to detect a magnitude of the load current (a value of the load current) in the lighting time period, and control the control element at a first response speed so as to make the value of the load current agree with a first target value. The at least one drive circuit further includes a second control circuit configured to detect the value of the load current in the lighting time period, and control the control element at a second response speed so that the value of the load current does not exceed an upper limit that is larger than the first target value. The second response speed is higher than the first response speed.

A luminaire according to an aspect of the present disclosure includes the lighting device and a luminaire body holding the lighting device.

BRIEF DESCRIPTION OF THE DRAWINGS

The figures depict one or more implementations in accordance with the present disclosure, by way of example only, not by way of limitations. In the figures, like reference numerals refer to the same or similar elements.

DETAILED DESCRIPTION

Hereinafter, a lighting device according to embodiments of the present disclosure and a luminaire according to an embodiment of the present disclosure will be described. Note that, configurations explained in the following embodiments are merely examples of the present disclosure. The present disclosure is not limited to the following embodiments. In the following embodiments, numerous modifications and variations can be made according to designs and the like without departing from the technical ideas according to the present disclosure.

First Embodiment

Figure 1:
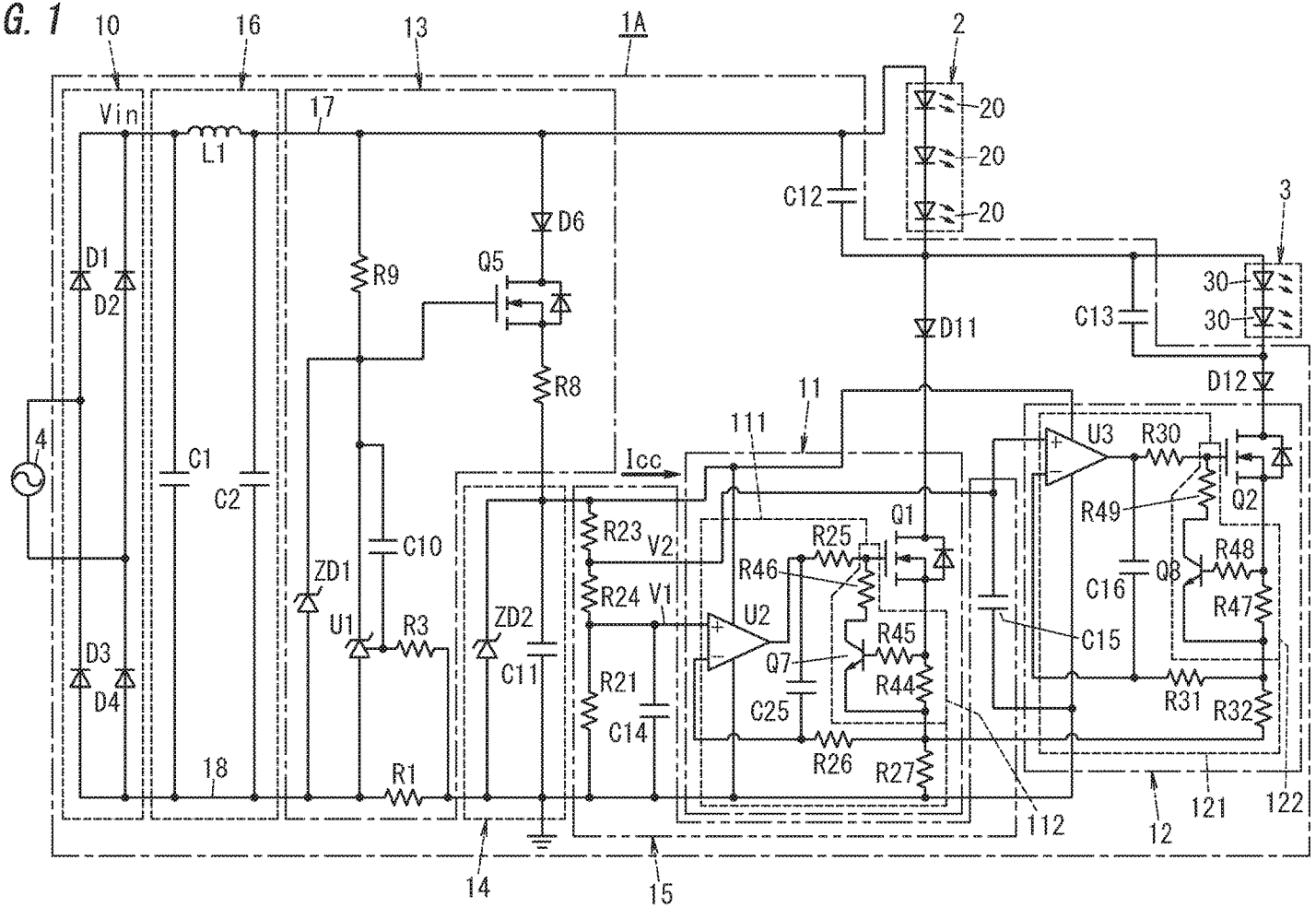
FIG. 1 is a circuit diagram of a lighting device according to a First Embodiment of the present disclosure.

As shown in FIG. 1, a lighting device 1A according to a First Embodiment includes a rectifier circuit 10, a first drive circuit 11, a second drive circuit 12, a bleeder circuit 13, a power supply circuit 14, a reference voltage circuit 15, and a filter circuit 16. The lighting device 1A is configured to supply an AC voltage (e.g., a sine wave AC voltage with a voltage effective value of 100V and a power supply frequency of 50 Hz or 60 Hz), received from an AC power supply 4, to at least one solid-state light source without AC-DC conversion so as to cause the solid-state light source to emit light. The solid-state light source is, for example, a white LED for illumination. Instead of the LED, the solid-state light source may be an organic electroluminescent element, a semiconductor laser, or the like.

The rectifier circuit 10 includes a bridge circuit with four diodes D1 to D4 (a diode bridge). The rectifier circuit 10 full-rectifies an AC voltage between two AC input terminals thereof, which is input from the AC power supply 4, and then outputs a pulsating voltage (input voltage Vin) and a pulsating current (input current Iin (refer to FIG. 2)) between two pulsating output terminals thereof. One of the two pulsating output terminals is electrically connected to an outward part of a conductive path (first conductive path 17). The other of the two pulsating output terminals is electrically connected to a return part of the conductive path (second conductive path 18).

The filter circuit 16 includes a choke coil L1 inserted in the first conductive path 17, and two capacitors (across-the-line capacitors) C1 and C2 electrically connected between the first and second conductive paths 17 and 18. In other words, the filter circuit 16 is a so-called it-type LC filter circuit. The filter circuit 16 filters a surge voltage superimposed in a power supply line electrically connecting the AC power supply 4 and the rectifier circuit 10 to protect the first drive circuit 11, the second drive circuit 12, the bleeder circuit 13, the power supply circuit 14 and the reference voltage circuit 15.

The first conductive path 17 has an end that is electrically connected to a positive electrode of a first LED array 2. The first LED array 2 has a negative electrode that is electrically connected to a positive electrode of a second LED array 3. The first LED array 2 includes a series circuit in which three LEDs 20 are connected in series. Also the second LED array 3 includes a series circuit in which two LEDs 30 are connected in series. Each of the first and second LED arrays 2 and 3 is electrically conductive and emits light (lights up), while a voltage applied between the positive and negative electrodes thereof is equal to or more than its ON voltage (a first ON voltage V21 or a second ON voltage V22 for the first and second LED arrays 2 and 3, respectively). The total value of the first and second ON voltages V21 and V22 (i.e., V21+V22) is lower than a peak value (e.g., $100V\times\sqrt{2}\approx141V$) of the input voltage Vin. For example, the total value is preferably lower than the peak value by 10% to 20% of the peak value. The number of the LEDs 20 of the first LED array 2 is not limited to three, and the number of the LEDs 30 of the second LED array 3 is not limited to two. The number of the LED arrays to be caused to emit light by the lighting device 1A is not limited to two. The lighting device 1A may be configured to cause three or more LED arrays to emit light. Note that, the first and second LED arrays 2 and 3 are not included in components of the lighting device 1A.

The lighting device 1A includes a smoothing capacitor C12 that is electrically connected in parallel to the first LED array 2 between the positive and negative electrodes of the first LED array 2. Furthermore, the lighting device 1A includes a smoothing capacitor C13 that is electrically connected in parallel between the positive and negative electrodes of the second LED array 3. The capacitors C12 and C13 smooth voltages and currents to be applied to the first and second LED arrays 2 and 3 to suppress variation in light to be emitted therefrom.

The first drive circuit 11 includes a transistor Q1 corresponding to a first control element, a first control circuit 111 and a second control circuit 112. The transistor Q1 is, for example, an enhancement type n-channel MOSFET (Metal-Oxide-Semiconductor Field Effect Transistor). The transistor Q1 has a drain that is electrically connected to a cathode of a diode D11, an anode of which is electrically connected to the negative electrode of the first LED array 2.

The first control circuit 111 includes an operational amplifier U2, a capacitor C25 and resistors R25 to R27. The resistor R27 has: an end that is electrically connected to a source of the transistor Q1; and another end that is electrically connected to the second conductive path 18. The resistor R25 has: an end that is electrically connected to a gate of the transistor Q1; and another end that is electrically connected to an output terminal of the operational amplifier U2. The operational amplifier U2 has: a positive input terminal to which the reference voltage circuit 15 outputs a first reference voltage V1; and a negative input terminal electrically connected to the source of the transistor Q1 via the resistor R26. The capacitor C25 is electrically connected in series to each of the output terminal and the negative input terminal of the operational amplifier U2. The operational amplifier U2 detects a drain current of the transistor Q1 from a voltage across the resistor R27, and adjusts its output voltage (a gate voltage of the transistor Q1) so as to make the voltage across the resistor R27 agree with the first reference voltage V1. That is, the first control circuit 111 adjusts (controls) the gate voltage of the transistor Q1 (voltage between the gate and the source) so as to make (a value of) a load current I2 (refer to FIG. 2) flowing through the first LED array 2 agree with a first target value corresponding to the first reference voltage V1, thereby performing constant current control. In this embodiment, the capacitor C25 and the resistors R25 and R26 constitute a phase compensating circuit for preventing the operational amplifier U2 from oscillating.

The second control circuit 112 includes a switch element Q7 and three resistors R44 to R46. The switch element Q7 is, for example, an NPN bipolar transistor. The switch element Q7 has a collector electrically connected to the gate of the transistor Q1 via the resistor R46. The switch element Q7 has a base electrically connected to the source of the transistor Q1 via the resistor R45. The resistor R44 has: an end electrically connected to the end of the resistor R27 and an emitter of the switch element Q7; and another end electrically connected to the source of the transistor Q1. While a voltage between the base and the emitter of the switch element Q7 is less than a threshold, the switch element Q7 is in an off-state, but, when the voltage between the base and the emitter thereof becomes equal to or more than the threshold, it is turned on. When the switch element Q7 is turned on, electric charges accumulated in the gate of the transistor Q1 are drawn out through the switch element Q7, and the transistor Q1 is therefore turned off. That is, while (the value of) the load current I2 is less than an upper limit, the second control circuit 112 maintains the switch element Q7 in the off-state, but, when the load current I2 becomes equal to or more than the upper limit, it switches the switch element Q7 to an on-state to turn off the transistor Q1, thereby reducing the load current I2.

The second drive circuit 12 includes a transistor Q2 corresponding to a second control element, a first control circuit 121 and a second control circuit 122. The transistor Q2 is, for example, an enhancement type n-channel MOSFET. The transistor Q2 has a drain that is electrically connected to a cathode of a diode D12, an anode of which is electrically connected to the negative electrode of the second LED array 3.

The first control circuit 121 includes an operational amplifier U3, a capacitor C16 and resistors R30 to R32. The resistor R32 has: an end that is electrically connected to a source of the transistor Q2; and another end that is electrically connected in series to the end of the resistor R27 of the first control circuit 111. The resistor R30 has: an end that is electrically connected to a gate of the transistor Q2; and another end that is electrically connected to an output terminal of the operational amplifier U3. The operational amplifier U3 has: a positive input terminal to which the reference voltage circuit 15 outputs a second reference voltage V2; and a negative input terminal electrically connected to the source of the transistor Q2 via the resistor R31. The capacitor C16 is electrically connected in series to each of the output terminal and the negative input terminal of the operational amplifier U3. The operational amplifier U3 detects a drain current (load current I3) of the transistor Q2 from a voltage between both ends of a series circuit formed by the resistors R32 and R27, and adjusts its output voltage (a gate voltage of the transistor Q2) so as to make the voltage between the both ends agree with the second reference voltage V2. That is, the first control circuit 121 makes the load current I3 flowing through the first and second LED arrays 2 and 3 agree with a second target value corresponding to the second reference voltage V2, thereby performing constant current control. In this embodiment, the capacitor C16 and the resistors R30 and R31 constitute a phase compensating circuit for preventing the operational amplifier U3 from oscillating.

The second control circuit 122 includes a switch element Q8 and three resistors R47 to R49. The switch element Q8 is, for example, an NPN bipolar transistor. The switch element Q8 has a collector electrically connected to the gate of the transistor Q2 via the resistor R49. The switch element Q8 has a base electrically connected to the source of the transistor Q2 via the resistor R48. The resistor R47 has: an end electrically connected to the end of the resistor R27 and an emitter of the switch element Q8; and another end electrically connected to the source of the transistor Q2. While a voltage between the base and the emitter of the switch element Q8 is less than a threshold, the switch element Q8 is in an off-state, but, when the voltage between the base and the emitter thereof becomes equal to or more than the threshold, it is turned on. When the switch element Q8 is turned on, electric charges accumulated in the gate of the transistor Q2 are drawn out through the switch element Q8, and the transistor Q2 is therefore turned off. That is, while (the value of) the load current I3 is less than an upper limit, the second control circuit 122 maintains the switch element Q8 in the off-state, but, when the load current I3 becomes equal to or more than the upper limit, it switches the switch element Q8 to an on-state to turn off the transistor Q2, thereby reducing the load current I3.

The power supply circuit 14 includes a parallel circuit in which a capacitor C11 and a constant voltage circuit (a constant voltage diode ZD2) are connected in parallel. The capacitor C11 is charged with a bleeder current supplied from the bleeder circuit 13. The constant voltage diode ZD2 clamps a voltage across the capacitor C11 to be equal to or less than a prescribed voltage (e.g., 6V to 15V). The power supply circuit 14 releases electric charges accumulated in the capacitor C11 to supply a current Icc (hereinafter, referred to as a "control-power-supply current" Icc) to the first and second drive circuits 11 and 12. Note that, the control-power-supply current Icc is preferably larger than a total of maximum values of current consumption in the operational amplifiers U2 and U3 of the first and second drive circuits 11 and 12 (each maximum value is for example 1 mA).

The reference voltage circuit 15 includes three voltage division resistors R21, R23 and R24, and two capacitors C14 and C15. The voltage division resistor R23 has: a first end electrically connected to a terminal on a high potential side, of the capacitor C11 (i.e., the terminal electrically connected to a cathode of the constant voltage diode ZD2); and a second end electrically connected to a first end of the voltage division resistor R24. A second end of the voltage division resistor R24 is electrically connected to a first end of the voltage division resistor R21, a second end of which is electrically connected to the second conductive path 18. The capacitor C14 is electrically connected in parallel to the voltage division resistor R21. The capacitor C15 is electrically connected in parallel to the voltage division resistors R21 and R24. In other words, the reference voltage circuit 15 generates the first reference voltage V1 by dividing a rated power supply voltage Vcc of the power supply circuit 14 (the voltage Vcc is approximately equal to a Zener voltage of the constant voltage diode ZD2) with the three voltage division resistors R21, R23 and R24. Also, the reference voltage circuit 15 generates the second reference voltage V2 by dividing the rated power supply voltage Vcc of the power supply circuit 14 with the one voltage division resistor R23 and a combined resistance of the two voltage division resistors R21 and R24. The second reference voltage V2 is higher than the first reference voltage V1.

The bleeder circuit 13 includes a transistor Q5, a shunt regulator U1, a constant voltage diode ZD1, resistors R1, R3, R8 and R9, a diode D6, and a capacitor C10. The diode D6 has an anode electrically connected to the first conductive path 17, and a cathode electrically connected to a drain of the transistor Q5. The transistor Q5 is an enhancement type n-channel MOSFET. The transistor Q5 has a source electrically connected to a first end of the resistor R8, a second end of which is electrically connected to a positive electrode of the power supply circuit 14 (a cathode of the constant voltage diode ZD1). The transistor Q5 has a gate electrically connected to a first end of the resistor R9, a cathode terminal of the shunt regulator U1, an end of the capacitor C10 and the cathode of the constant voltage diode ZD1. A second end of the resistor R9 is electrically connected to the first conductive path 17. An anode terminal of the shunt regulator U1 and an anode of the constant voltage diode ZD1 are electrically connected to the second conductive path 18. The shunt regulator U1 has a reference terminal electrically connected to a first end of the resistor R3 and another end of the capacitor C10. A second end of the resistor R3 is electrically connected to the second conductive path 18. The resistor R1 is between the anode terminal of the shunt regulator U1 and the resistor R3 in the second conductive path 18.

The gate of the transistor Q5 is biased via the resistor R9. When the gate is biased, the transistor Q5 is operated, and a drain current therefore flows. The drain current flows from the first conductive path 17 to the second conductive path 18 (resistor R1) via the diode D6, the transistor Q5, the resistor R8 and the power supply circuit 14. The shunt regulator U1 is an integrated circuit configured to adjust a current to be made flow to the anode terminal from the cathode terminal so as to make a voltage at the reference terminal, when viewed from the anode terminal, agree with the inside reference voltage. That is, the shunt regulator U1 increases the current flowing to the anode terminal from the cathode terminal, when the voltage at the reference terminal is increased depending on an increase in current flowing through the resistor R1. When, in the shunt regulator U1, the current to the anode terminal from the cathode terminal is increased, a voltage across the resistor R9 is also increased, and therefore, a gate voltage of the transistor Q5 is reduced. Thus, drain current of the transistor Q5, namely current flowing through the resistor R1 is reduced. On the other hand, the shunt regulator U1 decreases the current flowing to the anode terminal from the cathode terminal, when the voltage at the reference terminal is reduced depending on a decrease in current flowing through the resistor R1. When, in the shunt regulator U1, the current to the anode terminal from the cathode terminal is decreased, the voltage across the resistor R9 is also decreased, and therefore, the gate voltage of the transistor Q5 is increased. Thus, the drain current of the transistor Q5, namely the current flowing through the resistor R1 is increased. In other words, the shunt regulator U1 adjusts the current to be made flowing through the resistor R9 to be constant current to keep the gate voltage of the transistor Q5 constant, and the drain current (bleeder current) of the transistor Q5 is therefore made constant. Note that, the capacitor C10 moderates a change in the voltage at the reference terminal so as to reduce a response speed of the shunt regulator U1. Also, the constant voltage diode ZD1 prevents an overvoltage from being applied between the cathode terminal and the anode terminal of the shunt regulator U1.

Next, operation of the lighting device 1A in a case where the input voltage Vin is not being phase-controlled by a dimmer will be described in detail with reference to FIGS. 2 and 3. FIG. 3 shows a change of the input voltage Vin in a period of the input voltage Vin (a half period of the AC voltage: e.g., a phase: 0 rad to $\pi$ rad). All of the first and second LED arrays 2 and 3 and the bleeder circuit 13 stop operating in a section M0 from a point where the input voltage Vin is crossing zero volts (phase: 0 rad) to a point where operation of the transistor Q5 of the bleeder circuit 13 starts. Thus, the input current Iin is zero in this section.

Figure 2:
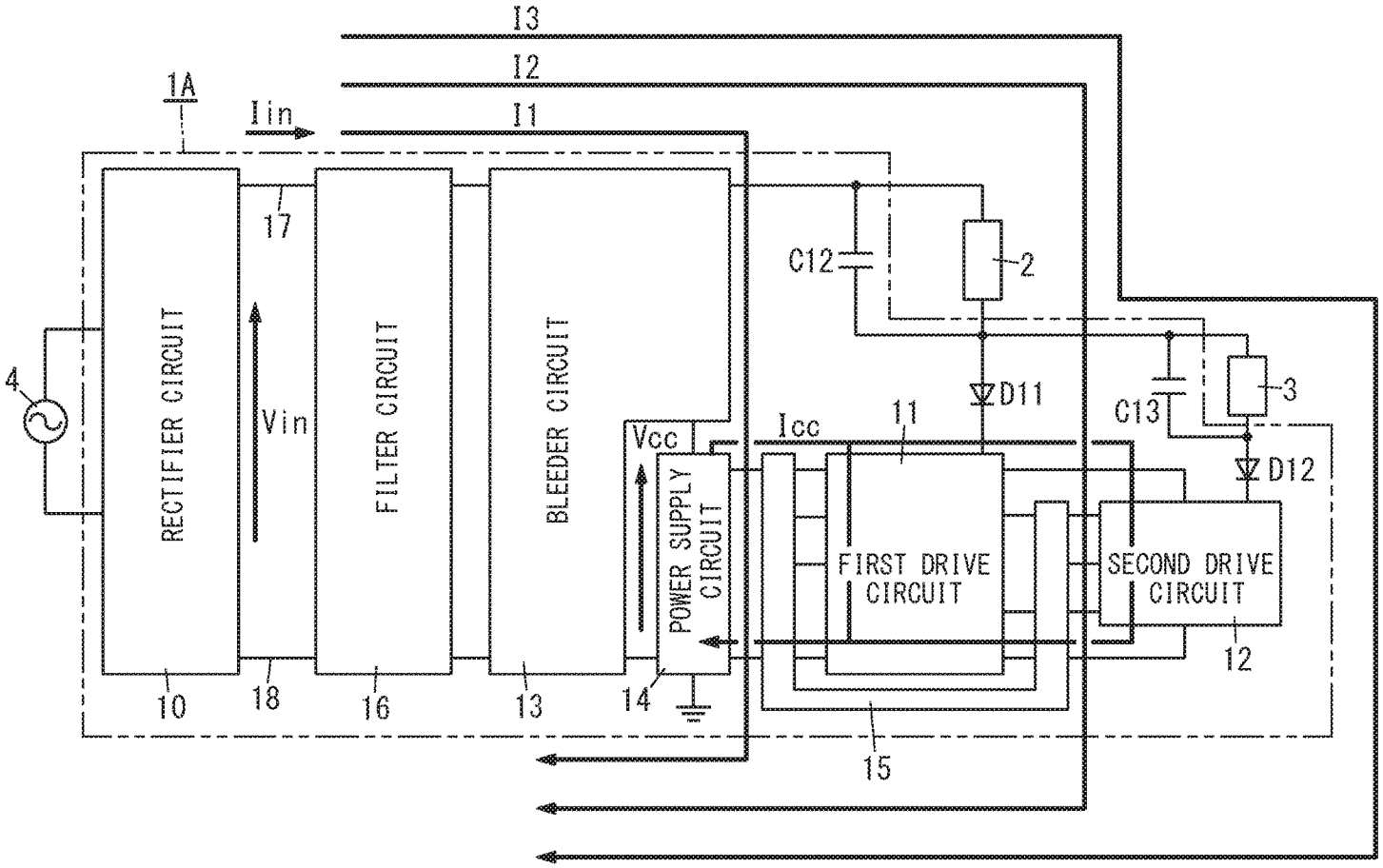
FIG. 2 is a circuit diagram for explaining operation of the lighting device.
Figure 3:
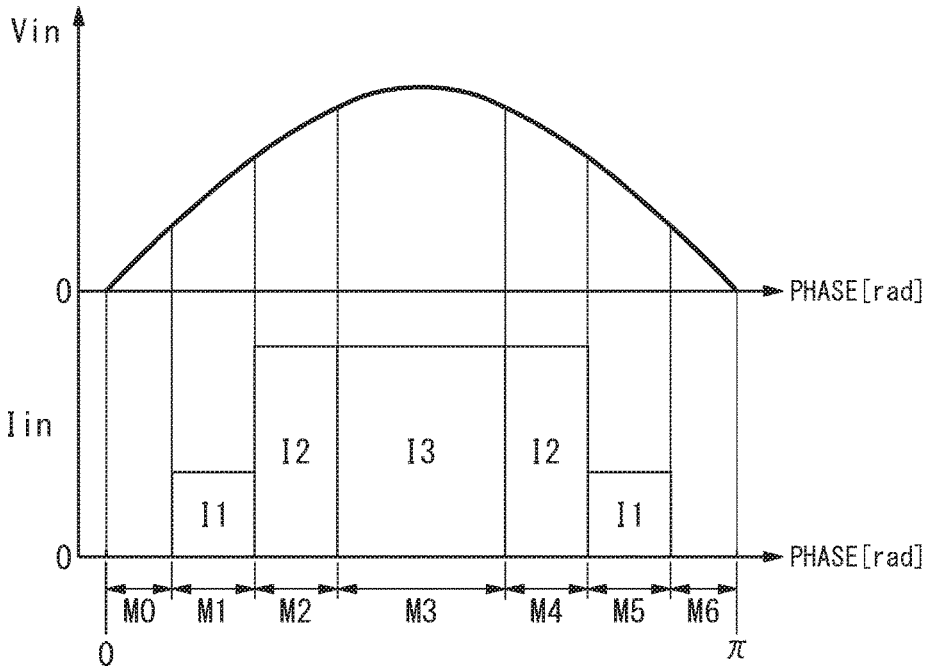
FIG. 3 is a waveform chart for explaining operation of the lighting device.

Then, when the input voltage Vin is increased and the voltage across the constant voltage diode ZD2 of the power supply circuit 14 exceeds the Zener voltage of the constant voltage diode ZD2, the bleeder current I1 flows to the power supply circuit 14 from the bleeder circuit 13 and the capacitor C11 is charged (refer to FIGS. 1 and 2). As a result, the control-power-supply current Icc is supplied from the power supply circuit 14 to the first and second drive circuits 11 and 12. In this embodiment, the bleeder circuit 13 is configured to make a flow of the bleeder current I1 with a value (e.g., 20 mA to 40 mA) larger than current (about 10 mA) required for self-holding of a TRIAC in the dimmer. The first and second LED arrays 2 and 3 are not conductive and in non-lighting in a section (section M1 in FIG. 3) from a phase at which operation of the bleeder circuit 13 starts to a phase at which the input voltage Vin becomes equal to or more than the first ON voltage V21. The first and second drive circuits 11 and 12 are still at stop.

When the input voltage Vin is increased to be equal to or more than the first ON voltage V21, the first LED array 2 is conductive and operation of the first drive circuit 11 is started. When the first drive circuit 11 is operated, the load current I2 starts to flow to the second conductive path 18 from the first conductive path 17 via the first LED array 2, the diode D11 and the first drive circuit 11, and therefore the first LED array 2 emits light (refer to FIG. 2). The first drive circuit 11 receives the control-power-supply current Icc from the power supply circuit 14, and operates to make the load current I2 flowing through the first LED array 2 agree with the first target value corresponding to the first reference voltage V1 so that the load current I2 is kept constant. Here, the voltage across the resistor R1 is increased by the load current I2 flowing through the second conductive path 18. For this reason, the bleeder circuit 13 makes the bleeder current I1 zero, if the first target value has been set to a value larger than the bleeder current I1. Note that, even when the bleeder current I1 is reduced to zero, the power supply circuit 14 can continue to supply the control-power-supply current Icc by discharging the charges stored in the capacitor C11. Only the first LED array 2 is in lighting but the second LED array 3 is in non-lighting in a section (section M2) from a phase at which the input voltage Vin becomes equal to the first ON voltage V21 to a phase at which the input voltage Vin becomes equal to a total value of the first and second ON voltages V21 and V22.

When the input voltage Vin is increased to be equal to or more than the total value of the first and second ON voltages V21 and V22, the second LED array 3 is also conductive together with the first LED array 2, and operation of the second drive circuit 12 is started. When the second drive circuit 12 is operated, the load current I3 starts to flow to the second conductive path 18 from the first conductive path 17 via the first LED array 2, the second LED array 3, the diode D12 and the second drive circuit 12, and therefore the first and second LED arrays 2 and 3 emit light (refer to FIG. 2). The second drive circuit 12 receives the control-power-supply current Icc from the power supply circuit 14, and operates to make the load current I3 agree with the second target value corresponding to the second reference voltage V2 so that the load current I3 is kept constant. Here, the voltage across the resistor R27 is increased by the load current I3 flowing through the second conductive path 18, and the input voltage of the negative input terminal of the operational amplifier U2 is therefore increased. For this reason, the first drive circuit 11 turns the transistor Q1 off. Also, the bleeder circuit 13 makes the bleeder current I1 zero, if the second target value has been set to a value larger than the bleeder current I1. Note that, similarly to the section M2, even when the bleeder current I1 is reduced to zero, the power supply circuit 14 can continue to supply the control-power-supply current Icc by discharging the charges stored in the capacitor C11. Both of the first and second LED arrays 2 and 3 are in lighting in a section (section M3) from a phase at which the input voltage Vin becomes the total value of the first and second ON voltages V21 and V22 to a phase at which the input voltage Vin is reduced below the total value of the first and second ON voltages V21 and V22.

The lighting device 1A performs the same operation as the section M2, in a section (section M4) from a phase at which the input voltage Vin passes through a peak value and becomes equal to the total value of the first and second ON voltages V21 and V22 to a phase at which the input voltage Vin becomes equal to the first ON voltage V21. In short, the sections M2 to M4 correspond to a lighting time period. Also, the lighting device 1A performs the same operation as the section M1, in a section (section M5) from a phase at which the input voltage Vin is reduced and becomes equal to the first ON voltage V21 to a phase at which the operation of the bleeder circuit 13 is stopped. Furthermore, the lighting device 1A performs the same operation as the section M0, in a section (section M6) in which the input voltage Vin is reduced and the operation of the bleeder circuit 13 is at stop. In short, the sections M0, M1, M5 and M6 correspond to a non-lighting time period.

As described above, the lighting device 1A, in a period of the input voltage Vin, can cause the first LED array 2 or both of the first and second LED arrays 2 and 3 to emit light in the sections M2 to M4 without converting the input voltage Vin into the DC voltage from the pulsating voltage. On the other hand, in a case where the input voltage Vin is phase-controlled by the dimmer, the lighting device 1A causes the first LED array 2 or both of the first and second LED arrays 2 and 3 to emit light only in a section(s) of phase where the input voltage Vin is equal to or more than the first ON voltage V21, of the sections M2 to M4. That is, the lighting device 1A can adjust dimming of the first and second LED arrays 2 and 3 under control of the dimmer.

Figure 4:
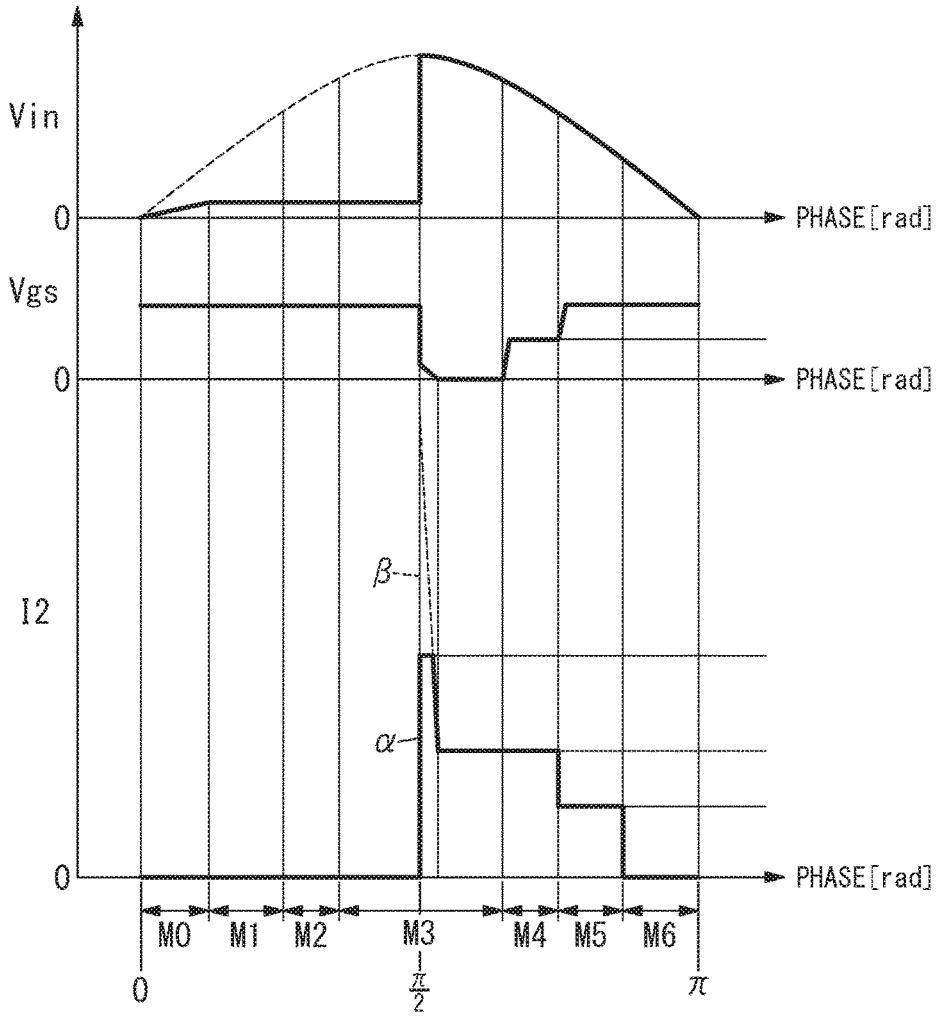
FIG. 4 is a waveform chart for explaining another operation of the lighting device.

Next, operation of the lighting device 1A in a case where the input voltage Vin is being phase-controlled by the dimmer will be described with reference to FIG. 4. FIG. 4 shows, in a period of the input voltage Vin, respective changes in the input voltage Vin, a voltage Vgs between the gate and the source of the transistor Q1 and the load current I2. In the following explanations, the input voltage Vin is being phase-controlled by the dimmer, and it is assumed that the TRIAC of the dimmer is in off, for example, during a time period in which a phase of the input voltage Vin is in 0 rad to $\pi/2$ rad (hereinafter, referred to as an off period).

In sections M1 and M2 of the off period, the transistor Q1 of the first drive circuit 11 is in on by the first control circuit 111. At this time, the load current I2 does not flow through the transistor Q1. Accordingly, the first control circuit 111 increases the voltage Vgs between the gate and the source of the transistor Q1 to the maximum (refer to FIG. 4). As a result, an ON resistance between the drain and the source of the transistor Q1 is minimized. In a section M3 of the off period, the transistor Q2 of the second drive circuit 12 is in on by the first control circuit 121. At this time, the load current I3 does not flow through the transistor Q2. Accordingly, the first control circuit 121 increases the voltage between the gate and the source of the transistor Q2 to the maximum. As a result, an ON resistance between the drain and the source of the transistor Q2 is minimized.

In the middle of the section M3, when the TRIAC of the dimmer is turned on, the input voltage Vin is suddenly increased to the peak value (about 141V) (refer to FIG. 4). At this time, because an ON resistance of the transistor Q1 in the first drive circuit 11 is at minimum, the load current I2 is rapidly increased to several amperes (e.g., about 4 A) from zero (refer to a broken line $\beta$ in FIG. 4). Similarly, because an ON resistance of the transistor Q2 in the second drive circuit 12 is at minimum, the load current I3 is rapidly increased to several amperes from zero. Then, the excessive load current I2 continues to flow, until the first control circuit 111 detects the load current I2 and reduces the voltage Vgs between the gate and the source of the transistor Q1. Similarly, the excessive load current I3 continues to flow, until the first control circuit 121 detects the load current I3 and reduces the voltage between the gate and the source of the transistor Q2. Peak values of the load currents I2 and I3 are slightly suppressed by the filter circuit 16.

Each of the first control circuits 111 and 121 is configured to feedback-control the voltage Vgs between the gate and the source of a corresponding transistor of the transistors Q1 and Q2 at a first response speed. Each of the second control circuits 112 and 122 is configured to turn off a corresponding transistor of the transistors Q1 and Q2 at a second response speed. In this embodiment, the second response speed is several times higher than the first response speed. That is, the input voltages at the negative input terminals of the operational amplifiers U2 and U3 in the first control circuits 111 and 121 are changed later than changes in the load currents I2 and I3, due to: an integration circuit of the capacitor C25 and the resistor R26; and an integration circuit of the capacitor C16 and the resistor R31 (an occurrence of a time delay). On the other hand, the second control circuits 112 and 122 do not have circuit elements that cause a time delay to occur in changes of the bases-emitter voltages of the switch elements Q7 and Q8 with respect to the changes in the load currents I2 and I3. Accordingly, when the load current I2 is rapidly increased, the second control circuit 112 can rapidly reduce the voltage Vgs between the gate and the source of the transistor Q1 so that the load current I2 is suppressed to be equal to or less than an upper limit (e.g., 0.5 A) (refer to a solid line $\alpha$ in FIG. 4). Similarly, when the load current I3 is rapidly increased, the second control circuit 122 can rapidly reduce the voltage between the gate and the source of the transistor Q2 so that the load current I3 is suppressed to be equal to or less than an upper limit. Note that, when the load currents I2 and I3 are reduced below the upper limits, the second control circuits 112 and 122 turn off the switch elements Q7 and Q8 so that the transistors Q1 and Q2 are made in on states, respectively. In order to prevent malfunction in the case where the input voltage Vin is not phase-controlled, the upper limits of the load currents I2 and I3 are preferably set to about 1.5 times to twice of the first and second target values, respectively. In a time period during which the TRIAC of the dimmer is in on (a time period from the middle of the section M3 to the end of the section M5), the first and second drive circuits 11 and 12 operate to make the load currents I2 and I3 constant.

Incidentally, it is possible to suppress rapid increases in the load currents I2 and I3 by using operational amplifiers with high response speeds, as the operational amplifiers U2 and U3 of the first and second control circuits 111 and 121. However, such the operational amplifiers with high response speeds generally have more power consumption and more expensive than operational amplifiers with low response speeds. On the other hand, regarding the lighting device 1A in this embodiment, since the drive circuits (first and second drive circuits 11 and 12) include the second control circuits 112 and 122, it is possible to form the operational amplifiers U2 and U3 of the first control circuits 111 and 121, using operational amplifiers with low response speeds. In addition, when a rapid increase in the input current Iin (load currents I2 and I3) is suppressed by the filter circuit 16, it leads to increase sizes of circuit components forming the filter circuit 16 (the choke coil L1 and the capacitors C1 and C2). On the other hand, regarding the lighting device 1A in this embodiment, it is possible to avoid increases in the sizes of such the circuit components forming the filter circuit 16, and further suppress the load currents I2 and I3 to be equal to or less than the upper limits.

In this embodiment, the filter circuit 16 preferably has a cutoff frequency that is higher than a first frequency and lower than a second frequency. The first frequency is a lower limit frequency by which a gain in a control response of each of the first control circuits 111 and 121 is made equal to or less than zero. The second frequency is a lower limit frequency by which a gain in a control response of each of the second control circuits 112 and 122 is made equal to or less than zero. The first frequency is determined by a time constant of an RC circuit of the resistor R26 and the capacitor C25, and a time constant of an RC circuit of the resistor R31 and the capacitor C16. That is, the first frequency corresponds to a cutoff frequency of a low-pass filter formed by the RC circuit of the resistor R26 and the capacitor C25, and a cutoff frequency of a low-pass filter formed by the RC circuit of the resistor R31 and the capacitor C16. Also, the second frequency is determined by turn-on times of bipolar transistors constituting the switch elements Q7 and Q8. In other words, the second frequency corresponds to a frequency (unity gain frequency) by which current gains falls to be equal to or less than zero, in frequency characteristics of the switch elements Q7 and Q8. Note that, the gains in the control response of the first control circuits 111 and 121 and the second control circuits 112 and 122 correspond to the current gains in the frequency characteristics of the switch elements Q7 and Q8. Since the filter circuit 16 is configured as above, it is possible to suppress increases in sizes of circuit components forming the filter circuit 16, and further suppress a rapid change in the input current Iin.

Figure 5:
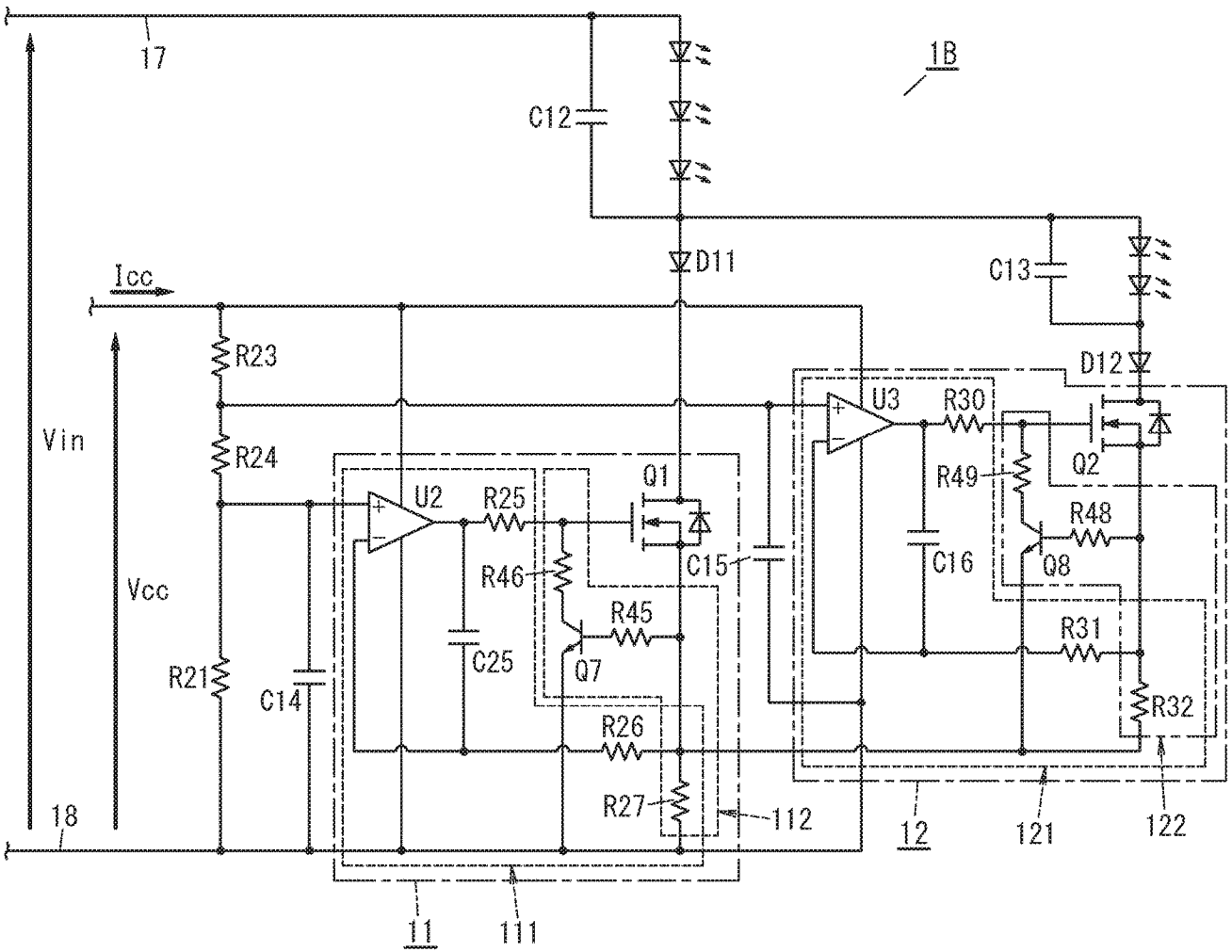
FIG. 5 is a circuit diagram, partially omitted, of a variation of the lighting device.

Incidentally, the second control circuits 112 and 122 may be configured to share resistors for detecting the load currents I2 and I3 with the first control circuits 111 and 121. For example, FIG. 5 shows in relevant part a lighting device 1B as a variation. In the lighting device 1B, instead of the resistor R44, the second control circuit 112 of the first drive circuit 11 uses the resistor R27 of the first control circuit 111, as a resistor for detecting the load current I2. That is, the emitter of the switch element Q7 is electrically connected to the second conductive path 18, and the voltage across the resistor R27 is applied between the base and the emitter of the switch element Q7. Accordingly, the second control circuit 112 operates to turn on the switch element Q7, when the excessive load current I2 flows, and the voltage across the resistor R27 exceeds the threshold of the switch element Q7.

Also, instead of the resistor R47, the second control circuit 122 of the second drive circuit 12 uses the resistor R32 of the first control circuit 121, as a resistor for detecting the load current I3. That is, the emitter of the switch element Q8 is electrically connected to a connecting point between the resistors R32 and R27, and the voltage across the resistor R32 is applied between the base and the emitter of the switch element Q8. Accordingly, the second control circuit 122 operates to turn on the switch element Q8, when the excessive load current I3 flows, and the voltage across the resistor R32 exceeds the threshold of the switch element Q8.

In the lighting device 1B as the variation, since the first control circuit 111 of the first drive circuit 11 and the second control circuit 112 of the first drive circuit 11 share the resistor R27 for detecting the load current I2, circuit elements can be reduced. Therefore, it is possible to reduce manufacturing cost and a size of a whole circuit. Furthermore, in the lighting device 1B as the variation, since the first control circuit 121 of the second drive circuit 12 and the second control circuit 122 of the second drive circuit 12 share the resistor R32 for detecting the load current I3, the circuit elements can be further reduced. Therefore, it is possible to further reduce manufacturing cost and a size of a whole circuit.

Second Embodiment

Figure 6:
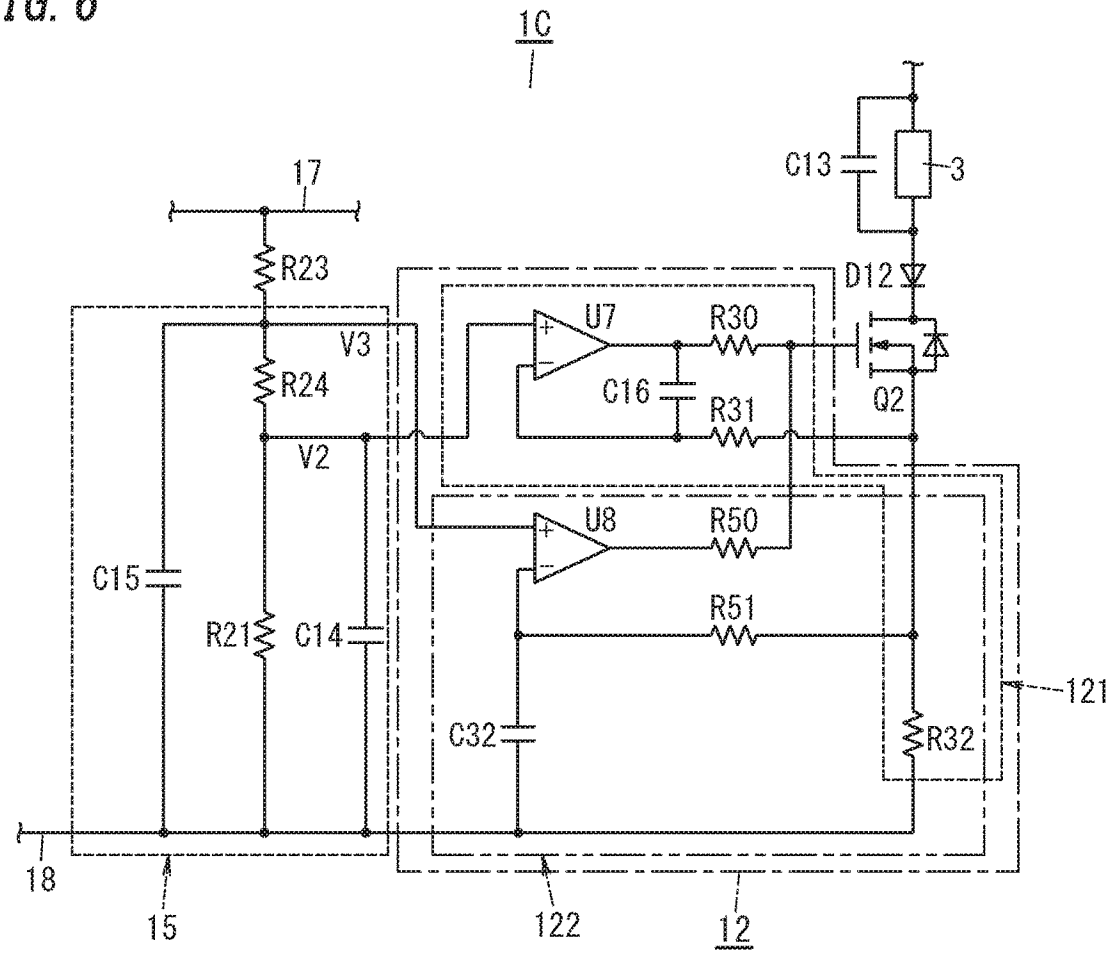
FIG. 6 is a circuit diagram, partially omitted, of a lighting device according to a Second Embodiment of the present disclosure.

As shown in relevant part in FIG. 6, a lighting device 1C according to a Second Embodiment is characterized in a configuration of a drive circuit (FIG. 6 shows only a second drive circuit 12). In the lighting device 1C, explanations and illustrations of other circuit configurations similar to those of the lighting devices 1A and 1B of the First Embodiment are accordingly omitted.

The second drive circuit 12 includes a transistor Q2, and a first control circuit 121 and a second control circuit 122 for controlling the transistor Q2. The first control circuit 121 includes an operational amplifier U7, a capacitor C16, and resistors R30 to R32. The resistor R32 has an end electrically connected to a source of the transistor Q2. The resistor R30 has: an end electrically connected to a gate of the transistor Q2; and another end electrically connected to an output terminal of the operational amplifier U7. The operational amplifier U7 has: a positive input terminal to which a reference voltage circuit 15 outputs a second reference voltage V2; and a negative input terminal electrically connected to the source of the transistor Q2 via the resistor R31. The capacitor C16 is electrically connected in series to the output terminal and the negative input terminal of the operational amplifier U7. The operational amplifier U7 detects a drain current (load current I3) of the transistor Q2 from a voltage across the resistor R32, and adjusts its output voltage (a gate voltage of the transistor Q2) so as to make the voltage across the resistor R32 agree with the second reference voltage V2. That is, the first control circuit 121 makes the load current I3 flowing through first and second LED arrays 2 and 3 agree with a second target value corresponding to the second reference voltage V2, thereby performing constant current control. In this embodiment, the capacitor C16 and the resistors R30 and R31 constitute a phase compensating circuit for preventing the operational amplifier U7 from oscillating. A first response speed of the first control circuit 121 is determined by a time constant $\tau 1$ of a circuit of the resistor R31 and the capacitor C16.

The second control circuit 122 includes a comparator U8, a capacitor C32, and resistors R50, R51 and R32. The resistor R50 has: an end electrically connected to an output terminal of the comparator U8; and another end electrically connected to the gate of the transistor Q2. The resistor R51 has: an end electrically connected to a connecting point between the source of the transistor Q2 and the resistor R32; and another end electrically connected to a negative input terminal of the comparator U8. The capacitor C32 has: an end electrically connected to the negative input terminal of the comparator U8; and another end electrically connected to the other end of the resistor R32. The comparator U8 has a positive input terminal to which the reference voltage circuit 15 outputs a third reference voltage V3. Here, a second response speed of the second control circuit 122 is determined by a time constant $\tau 2$ of a circuit of the resistor R51 and the capacitor C32. The time constant $\tau 2$ of the second control circuit 122 is sufficiently less than the time constant $\tau 1$ of the first control circuit 121. For this reason, the second response speed of the second control circuit 122 is sufficiently higher than the first response speed of the first control circuit 121.

The first drive circuit 11 also includes first and second control circuits having circuit configurations similar to those of the first and second control circuits 121 and 122 of the second drive circuit 12, although the illustrations and explanations thereof are omitted.

The reference voltage circuit 15 includes three resistors R21, R23 and R24, and two capacitors C14 and C15. The resistor R23 has: an end electrically connected to a first conductive path 17; and another end electrically connected to an end of the resistor R24. The resistor R24 has another end electrically connected to an end of the resistor R21, another end of which is electrically connected to a second conductive path 18. The capacitor C14 is electrically connected in parallel to the resistor R21. The capacitor C15 is electrically connected in parallel to a series circuit of the two resistors R24 and R21. The reference voltage circuit 15 generates the second reference voltage V2 and the third reference voltage V3 higher than the second reference voltage V2, by dividing the input voltage Vin applied between the first and second conductive paths 17 and 18 with a voltage dividing circuit constituted by a series circuit of the three resistors R23, R24 and R21. The second and third reference voltages V2 and V3 are smoothed by the capacitors C14 and C15 to be kept approximately constant. Alternatively, the reference voltage circuit 15 may be configured to change the second and third reference voltages V2 and V3 so as to follow a change in the input voltage Vin, using the capacitors C14 and C15 with sufficiently small capacitances.

Next, operation of the second drive circuit 12 in a case where the input voltage Vin is not being phase-controlled by a dimmer will be described. When the input voltage Vin is increased to be equal to or more than a total value of the first and second ON voltages V21 and V22, the second LED array 3 is conductive together with the first LED array 2, and operation of the second drive circuit 12 is started. The first control circuit 121 of the second drive circuit 12 controls a voltage between the gate and the source of the transistor Q2 so as to make (the value of) the load current I3 flowing through the resistor R32 agree with the second target value corresponding to the second reference voltage V2. On the other hand, the second control circuit 122 compares (the value of) the load current I3 flowing through the resistor R32 with an upper limit corresponding to the third reference voltage V3. In the case where the input voltage Vin is not being phase-controlled, the load current I3 hardly exceeds the upper limit, and accordingly, an output level of the second control circuit 122 (an output level of the comparator U8) is at a high level. That is, the voltage between the gate and the source of the transistor Q2 is controlled by the first control circuit 121.

Next, operation of the second drive circuit 12 in a case where the input voltage Vin is being phase-controlled by the dimmer will be described. In the following explanations, it is assumed that a TRIAC of the dimmer is in off during a time period in which a phase of the input voltage Vin is in 0 rad to $\pi/2$ rad (hereinafter, referred to as an off period).

In a section near a peak value of the input voltage Vin, of the off period, the first control circuit 121 increases the voltage between the gate and the source of the transistor Q2 to the maximum. As a result, an ON resistance between the drain and the source of the transistor Q2 is minimized. When the TRIAC of the dimmer is turned on, the input voltage Vin is suddenly increased to the peak value (about 141V). At this time because an ON resistance of the transistor Q2 in the second drive circuit 12 is at minimum, the load current I3 is rapidly increased to several amperes from zero. When the load current I3 is rapidly increased, the output level of the second control circuit 122 (the output level of the comparator U8) is changed from a high level to a low level before the output level of the first control circuit 121 does so. When the output level of the second control circuit 122 is changed to the low level, electric charges accumulated in the gate of the transistor Q2 are drawn out through the second control circuit 122, and the transistor Q2 is therefore turned off. That is, when the load current I3 becomes equal to or more than the upper limit, the second control circuit 122 turns off the transistor Q2, thereby reducing the load current I3.

Similarly to the lighting devices 1A and 1B of the First Embodiment, the lighting device 1C of this embodiment can suppress an overcurrent when the input voltage Vin is subjected to phase control. Furthermore, since the second control circuit 122 of the lighting device 1C of this embodiment turns off the transistor Q2 by the comparator U8, it is possible to further increase the second response speed of the second control circuit 122, compared with the case of the lighting devices 1A and 1B where the transistor Q2 is turned off by the switch element Q8 as a bipolar transistor. As a result, the lighting device 1C reduces the upper limit in the second control circuit 122 so as to approach the second target value, and the overcurrent can be therefore further suppressed. Also in the case where the reference voltage circuit 15 changes the second and third reference voltages V2 and V3 so as to follow the input voltage Vin, the second control circuit 122 changes the upper limit of the load current I3 so as to follow the input voltage Vin. As a result, the lighting device 1C can suppress the overcurrent with good accuracy in the case where phase dimming control is performed by the dimmer. Note that, in the second drive circuit 12 of the lighting device 1C, it is possible to downsize the whole circuit by forming, as a single integrated circuit, the operational amplifier U7 of the first control circuit 121 and the comparator U8 of the second control circuit 122.

As apparent from the above-mentioned embodiments, a lighting device (1A; 1B; 1C) of a first aspect includes a rectifier circuit 10 configured to rectify an AC voltage to output a pulsating voltage (input voltage Vin). The lighting device (1A; 1B; 1C) further includes at least one drive circuit (first drive circuit 11; second drive circuit 12) configured to, within a period of the pulsating voltage, switch between a lighting time period and a non-lighting time period in accordance with a voltage value of the pulsating voltage (input voltage Vin), the lighting time period being for supplying a load current (I2; I3) to a corresponding solid-state light source (LEDs 20; 30), and the non-lighting time period being for supplying no load current (I2; I3) to the corresponding solid-state light source (LEDs 20; 30). Each of the at least one drive circuit (first drive circuit 11; second drive circuit 12) includes: a control element (transistors Q1; Q2) adjusting the load current (I2; I3) to the corresponding solid-state light source (LEDs 20; 30); a first control circuit (111; 121); and a second control circuit (112; 122). The first control circuit (111; 121) is configured to detect a value of the load current (I2; I3) in the lighting time period, and control the control element (transistors Q1; Q2) at a first response speed so as to make the value of the load current (I2; I3) agree with a first target value. The second control circuit (112; 122) is configured to detect the value of the load current (I2; I3) in the lighting time period, and control the control element (transistors Q1; Q2) at a second response speed so that the value of the load current (I2; I3) does not exceed an upper limit that is larger than the first target value. The second response speed is higher than the first response speed.

According to the lighting device (1A; 1B; 1C) of the first aspect, the second control circuit (112; 122) can control the control element (transistors Q1; Q2) at the second response speed higher than the first response speed and suppress the load current (I2; I3) to be equal to or less than the upper limit. Therefore, the lighting device (1A; 1B; 1C) of the first aspect can suppress an overcurrent when the pulsating voltage (input voltage Vin) is subjected to phase control.

A lighting device (1A; 1B; 1C) of a second aspect may be realized in combination with the first aspect. In the lighting device (1A; 1B; 1C) of the second aspect, the first control circuit (111; 121) includes a detection element (resistors R27; R32) detecting the value of the load current (I2; I3), and configured to control the control element (transistors Q1; Q2) in accordance with the value of the load current (I2; I3) detected by the detection element (resistors R27; R32). The second control circuit (112; 122) is configured to share the detection element (resistors R27; R32) with the first control circuit (111; 121), and control the control element (transistors Q1; Q2) in accordance with the value of the load current (I2; I3) detected by the detection element (resistors R27; R32).

According to the lighting device (1A; 1B; 1C) of the second aspect, since the first control circuit (111; 121) and the second control circuit (112; 122) shares the single detection element (resistors R27; R32), it is possible to reduce circuit elements.

A lighting device (1C) of a third aspect may be realized in combination with the first or second aspect. In the lighting device (1C) of the third aspect, the second control circuit (112; 122) is configured to change the upper limit in accordance with the pulsating voltage (input voltage Vin).

According to the lighting device (1C) of the third aspect, it is possible to suppress the overcurrent with good accuracy when phase dimming control is performed by a dimmer.

A lighting device (1A; 1B; 1C) of a fourth aspect may be realized in combination with any one of the first to third aspects. The lighting device (1A; 1B; 1C) of the fourth aspect further includes a filter circuit (16) disposed on an input side or an output side of the rectifier circuit (10), the filter circuit (16) being configured to attenuate a high harmonic component in an input thereto (input voltage Vin; input current Iin).

According to the lighting device (1A; 1B; 1C) of the fourth aspect, it is possible to suppress a rapid change in the load current (I2; I3).

A lighting device (1A; 1B; 1C) of a fifth aspect may be realized in combination with the fourth aspect. In the lighting device (1A; 1B; 1C) of the fifth aspect, the filter circuit (16) has a cutoff frequency that is higher than a first frequency and lower than a second frequency. The first frequency is a lower limit frequency by which a gain in a control response of the first control circuit (111; 121) is made equal to or less than zero. The second frequency is a lower limit frequency by which a gain in a control response of the second control circuit (112; 122) is made equal to or less than zero.

According to the lighting device (1A; 1B; 1C) of the fifth aspect, it is possible to suppress increases in sizes of circuit components forming the filter circuit (16), and further suppress the rapid change in the input current Iin (load currents I2; I3).

A lighting device (1A; 1B; 1C) of a sixth aspect may be realized in combination with any one of the first to fifth aspects. In the lighting device (1A; 1B; 1C) of the sixth aspect, the at least one drive circuit includes a plurality of drive circuits (first drive circuit 11; second drive circuit 12) configured to supply the load current (I2; I3) to the corresponding solid-state light sources.

According to the lighting device (1A; 1B; 1C) of the sixth aspect, it is possible to suppress the overcurrent when the pulsating voltage (input voltage Vin) is subjected to the phase control.

A lighting device (1A; 1B; 1C) of a seventh aspect may be realized in combination with the sixth aspect. In the lighting device (1A; 1B; 1C) of the seventh aspect, in each of the plurality of drive circuits (first drive circuit 11; second drive circuit 12): the first control circuit (111; 121) includes a detection element (resistors R27; R32) detecting the value of the load current (I2; I3), and configured to control the control element (transistors Q1; Q2) in accordance with the value of the load current (I2; I3) detected by the detection element (resistors R27; R32); and the second control circuit (112; 122) is configured to share the detection element (resistors R27; R32) with the first control circuit (111; 121), and control the control element (transistors Q1; Q2) in accordance with the value of the load current (I2; I3) detected by the detection element (resistors R27; R32).

A lighting device (1A; 1B; 1C) of an eighth aspect may be realized in combination with the sixth aspect. In the lighting device (1A; 1B; 1C) of the eighth aspect, the plurality of drive circuits include a first drive circuit (11) and a second drive circuit (12), and within the period of the pulsating voltage there exists a time period during which neither the first drive circuit (11) nor the second drive circuit (12) supplies the load current to the corresponding solid-state light source, a time period during which the first drive circuit (11) supplies the load current and the second drive circuit (12) does not supply the load current to the corresponding solid-state light sources, and a time period during which both the first drive circuit (11) and the second drive circuit (12) supply the load currents to the corresponding solid-state light sources.

A lighting device (1A; 1B; 1C) of a ninth aspect may be realized in combination with the sixth aspect. The lighting device (1A; 1B; 1C) of the ninth aspect further includes a filter circuit (16) disposed on an input side or an output side of the rectifier circuit (10), the filter circuit (16) being configured to attenuate a high harmonic component in an input thereto (input voltage Vin).

According to the lighting device (1A; 1B; 1C) of the ninth aspect, it is possible to suppress the rapid change in the load current (I2; I3).

Third Embodiment

Hereinafter, a luminaire according to a Third Embodiment will be described in detail.

Figure 7C:
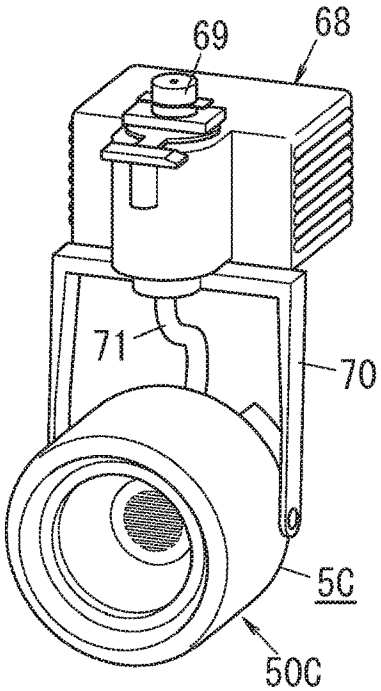
FIG. 7C is a perspective view of a Variation 2 of the luminaire.
Figure 7B:
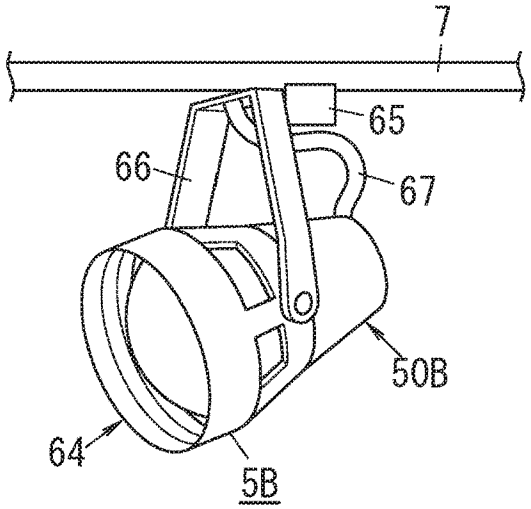
FIG. 7B is a perspective view of a Variation 1 of the luminaire.
Figure 7A:
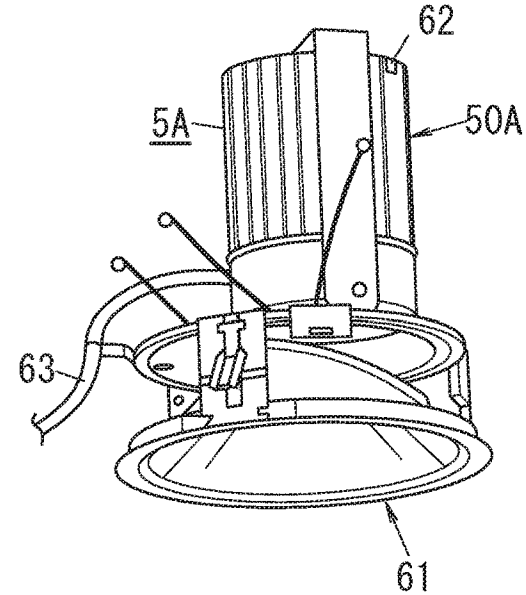
FIG. 7A is a perspective view of a luminaire according to a Third Embodiment of the present disclosure.

FIG. 7A shows is a perspective view of a luminaire 5A according to this embodiment.

This luminaire 5A includes any one of the lighting devices 1A to 1C of the First and Second Embodiments, and a luminaire body 50A housing the one of the lighting devices 1A to 1C.

The luminaire 5A is provided as a downlight to be embedded and disposed in a ceiling. The luminaire 5A includes: the luminaire body 50A housing the first LED array 2, the second LED array 3 and any one of the lighting devices 1A to 1C; and a reflector 61. The luminaire body 50A is provided at an upper part thereof with heat radiating fins 62. A power supply cable 63 is derived from the luminaire body 50A. The power supply cable 63 electrically connects the lighting device in the luminaire body 50A and the AC power supply 4.

The luminaire is not limited to the downlight, but may be provided as a spotlight or other forms.

FIGS. 7B and 7C respectively show luminaires 5B and 5C provided as spotlights to be attached to a wiring duct 7.

In other words, FIGS. 7B and 7C respectively show the luminaire 5B (a Variation 1) and the luminaire 5C (a Variation 2) provided as spotlights to be attached to the wiring duct 7.

As shown in FIG. 7B, the luminaire 5B of the Variation 1 includes a luminaire body 50B, a reflector 64, a connector part 65 and an arm part 66. The luminaire body 50B is formed to house the first LED array 2, the second LED array 3 and any one of the lighting devices 1A to 1C. The connector part 65 is attached to the wiring duct 7. The arm part 66 connects the connector part 65 and the luminaire body 50B. The lighting device (any one of the lighting devices 1A to 1C) in the luminaire body 50B and the connector part 65 are connected to each other with a power supply cable 67.

Also, as shown in FIG. 7C, the luminaire 5C of the Variation 2 includes a luminaire body 50C, a box 68, a connecting part 70 and a power supply cable 71. The luminaire body 50C is formed to house the first LED array 2 and the second LED array 3. The box 68 is formed to house the lighting device (any one of the lighting devices 1A to 1C). The connecting part 70 connects the luminaire body 50C and the box 68. The power supply cable 71 electrically connects the first and second LED arrays 2 and 3 in the luminaire body 50C, and the lighting device (any one of the lighting devices 1A to 1C) in the box 68. Note that, the box 68 is provided on an upper surface thereof with a connector part 69 to be electrically and mechanically connected to the wiring duct 7 in a detachable manner.

As apparent from the above-mentioned embodiment, a luminaire (5A; 5B; 5C) of a tenth aspect includes: the lighting device (1A; 1B; 1C) of any one of the first to ninth aspects; and a luminaire body (50A; 50B; 50C) holding the lighting device (1A; 1B; 1C).

According to the luminaire (5A; 5B; 5C) of the tenth aspect, since the luminaire includes the lighting device (1A; 1B; 1C), it is possible to suppress the overcurrent when the pulsating voltage (input voltage Vin) is subjected to phase control.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A lighting device, comprising:

a rectifier circuit configured to rectify an AC voltage to output a pulsating voltage; and at least one drive circuit configured to, within a period of the pulsating voltage, switch between a lighting time period and a non-lighting time period in accordance with a voltage value of the pulsating voltage, the lighting time period being for supplying a load current to a corresponding solid-state light source, and the non-lighting time period being for supplying no load current to the corresponding solid-state light source, each of the at least one drive circuit including:

a control element adjusting the load current to the corresponding solid-state light source;

a first control circuit configured to detect a value of the load current in the lighting time period, and control the control element at a first response speed so as to make the value of the load current agree with a first target value; and a second control circuit configured to detect the value of the load current in the lighting time period, and control the control element at a second response speed so that the value of the load current does not exceed an upper limit that is larger than the first target value, the second response speed being higher than the first response speed.

2. The lighting device of claim 1, wherein:

the first control circuit includes a detection element detecting the value of the load current, and configured to control the control element in accordance with the value of the load current detected by the detection element; and the second control circuit is configured to share the detection element with the first control circuit, and control the control element in accordance with the value of the load current detected by the detection element.

3. The lighting device of claim 1, wherein:

the second control circuit is configured to change the upper limit in accordance with the pulsating voltage.

4. The lighting device of claim 1, further comprising a filter circuit disposed on an input side or an output side of the rectifier circuit, the filter circuit being configured to attenuate a high harmonic component in an input thereto.

5. The lighting device of claim 4, wherein:

the filter circuit has a cutoff frequency that is higher than a first frequency and lower than a second frequency;

the first frequency is a lower limit frequency by which a gain in a control response of the first control circuit is made equal to or less than zero; and the second frequency is a lower limit frequency by which a gain in a control response of the second control circuit is made equal to or less than zero.

6. The lighting device of claim 1, wherein:

the at least one drive circuit comprises a plurality of drive circuits configured to supply the load current to the corresponding solid-state light sources.

7. The lighting device of claim 6, wherein in each of the plurality of drive circuits:

the first control circuit includes a detection element detecting the value of the load current, and configured to control the control element in accordance with the value of the load current detected by the detection element; and the second control circuit is configured to share the detection element with the first control circuit, and control the control element in accordance with the value of the load current detected by the detection element.

8. The lighting device of claim 6, wherein:

the plurality of drive circuits include a first drive circuit and a second drive circuit, and within the period of the pulsating voltage there exists a time period during which neither the first drive circuit nor the second drive circuit supplies the load current to the corresponding solid-state light source, a time period during which the first drive circuit supplies the load current and the second drive circuit does not supply the load current to the corresponding solid-state light sources, and a time period during which both the first drive circuit and the second drive circuit supply the load currents to the corresponding solid-state light sources.

9. The lighting device of claim 6, further comprising a filter circuit disposed on an input side or an output side of the rectifier circuit, the filter circuit being configured to attenuate a high harmonic component in an input thereto.

10. A luminaire, comprising:

the lighting device of claim 1; and a luminaire body holding the lighting device.

* * * * *